US007353754B2

(12) United States Patent
Muench et al.

(10) Patent No.: US 7,353,754 B2
(45) Date of Patent: Apr. 8, 2008

(54) APPARATUS AND METHOD FOR MARKING A J-LINE

(75) Inventors: Rudolf Muench, Koenigsbronn (DE); Egon Bild, Meerbusch (DE); Siegfried Daum, Hilden (DE); Joerg Maurer, Steinheim (DE); Tobias Wanke, Steinheim (DE); Werner Reichert, Frickingen (DE); Wolfgang Klotzbuecher, Gerstetten (DE); Josef Wigand, Herbrechtingen (DE)

(73) Assignee: Voith Patent GmbH, Heidenheim (DE)

( * ) Notice: Subject to any disclaimer, the term of this patent is extended or adjusted under 35 U.S.C. 154(b) by 134 days.

(21) Appl. No.: 11/080,099

(22) Filed: Mar. 14, 2005

(65) Prior Publication Data

US 2005/0211817 A1 Sep. 29, 2005

(30) Foreign Application Priority Data

Mar. 16, 2004 (DE) ..... 10 2004 012 727

(51) Int. Cl.

| | |
|---|---|
| ***B41L 47/30*** | (2006.01) |
| ***B65H 23/18*** | (2006.01) |
| *B65H 23/10* | (2006.01) |
| *B65H 23/04* | (2006.01) |

(52) U.S. Cl. ..... 101/92; 242/410; 242/412.3

(58) Field of Classification Search ..... 162/118, 162/197–198; 242/534, 416; 226/174, 176, 226/17, 24, 30, 45

See application file for complete search history.

(56) References Cited

U.S. PATENT DOCUMENTS

| | | | | |
|---|---|---|---|---|
| 4,828,156 | A * | 5/1989 | Whiteley et al. | 226/1 |
| 5,039,023 | A | 8/1991 | Hagens et al. | 242/67.1 |
| 5,799,577 | A | 9/1998 | Takahashi | 101/127 |
| 6,209,817 | B1 * | 4/2001 | Conrad et al. | 242/534 |

FOREIGN PATENT DOCUMENTS

JP 2000-219368 * 8/2000

* cited by examiner

*Primary Examiner*—Daniel J. Colilla
*Assistant Examiner*—'Wynn' Q. Ha
(74) *Attorney, Agent, or Firm*—Taylor & Aust, P.C.

(57) ABSTRACT

A marking unit having a writing device that marks a material web which can be wound up onto a core by a winding device to form a reel, the marking device having a signal generator that is operatively connected to the core of the winding device. Depending on the rotation of the core, the signal generator outputs a clock signal to the writing device for marking the material web.

14 Claims, 1 Drawing Sheet

APPARATUS AND METHOD FOR MARKING A J-LINE

CROSS-REFERENCE TO RELATED APPLICATIONS

The present application claims priority under 35 U.S.C. § 119 of German Patent Application No. 10 2004 012 727.1, filed on Mar. 16, 2004, the disclosure of which is expressly incorporated by reference herein in its entirety.

BACKGROUND OF THE INVENTION

1. Field of the Invention

The invention relates to a marking unit for marking a material web that can be wound up onto a core utilizing a winding device, and also to a corresponding marking method for this purpose.

2. Description of Background

In the web processing and producing industry, such as the paper industry, for example, material webs are wound onto a core by means of winding devices at various stages of production. In this case, the winding devices are often known as reelers, in which the core with the material web already wound up, referred to as a reel, is in contact with one or more pressure rolls, a nip formed between the reel and the pressure roll.

During the winding of the material web, for example, because of changes in web tension upstream of the nip or because of the elasticity of the material web or because of the action of force in the nip, positional displacement of the material web wound onto the core can occur. Such positional displacement can lead to winding defects such as creping folds or breakage of the material web.

In order to detect positional displacements, manual methods of marking are used as required, in which radial lines are applied successively to the end of the part of the material web already wound and the change in the lines is observed over the course of further winding operation and subsequently analyzed. If, in the ideal case, no positional displacements have taken place, then the lines applied would ideally result in a radial line over the entire thickness of the wound material web. However, due to positional displacement, a line with a J shape, what is known as a J-line, is established over the thickness of the wound material web. A highly deformed J-line results when severe positional displacements occur. Furthermore, the wound tension is incorporated in the shape of the J-line. Thus, the J-line is, for example, deformed less severely if the web tension is increased before reeling, that is to say when harder winding is carried out.

The disadvantage with the known mechanical methods is that the manual application of the marking line is dangerous for the person carrying it out as a result of the proximity to the rotating reel. Furthermore, the reproducibility of the manual marking depends to a great extent on the skill of the person carrying it out. Moreover, the manual methods cannot be applied in a prophylactic manner since the winding quality can only be determined retrospectively.

BRIEF SUMMARY OF THE INVENTION

It is an object of the present invention to have a marking unit and a marking method in which the above-mentioned problems are overcome.

In the preferred embodiment, the marking unit has a writing device that places marks on a material web which can be wound up onto a core by means of a winding device, and the marking device has a signal generator which is operatively connected to the core of the winding device, so that, depending on the rotation of the core, a clock signal is output by the signal generator on the basis of which the writing device places a mark on the material web.

According to the preferred embodiment, therefore, a device automatically marks the material web to be wound up or wound up onto a core. The solution according to the invention thus ensures high reproducibility. Furthermore, according to the invention it is no longer necessary for the markings to have to be made by a person who is placed in danger by being in close proximity to the rotating reel.

Different possibilities are conceivable as to when the signal generator outputs a clock signal to the writing device. In an embodiment of the invention, the signal generator is fitted in such a way that a clock signal is output upon each completed revolution of the core. However, it is also conceivable for a clock signal to be output at each half or quarter revolution of the center of rotation of the core.

Furthermore, different possibilities are conceivable for arranging the signal generator. According to another embodiment, the signal generator can be arranged at the center of rotation of the core.

According to a another embodiment of the invention, the writing device is arranged with respect to the material web such that the marking can be applied to the end of the material web.

The writing device can be arranged relative to the winding device at various locations.

In general, it has been shown in trials that different courses of the patterns, for example of the various J-lines, result, depending on the location of the writing device when the markings are applied.

In one embodiment of the invention, provision is made for the winding device to have a pressure roll, which forms a nip with the reel, and for the writing device to be arranged upstream of the nip in relation to the direction of movement of the material web. This arrangement of the writing device, results in both changes in web tension on the material web and also, for example, the actions of force of the nip on the material web are incorporated in the pattern, for example J-line, formed by the markings.

According to another embodiment of the invention, the writing device can be arranged in such a way that, by means of the latter, the material web already wound up can be marked, that is to say the writing device is arranged downstream of the nip in relation to the direction of movement of the material web. Downstream of the nip, the web tension acting on the material web upstream of the nip has already, to some extent been dissipated. The shape of this pattern, for example the J-line, is thus determined in a different relationship by the web tension than in the case of marking the material web upstream of the nip.

Another embodiment of the invention is a writing device arranged in the region of the nip, resulting in the shape of the pattern, for example of the J-line, is once more influenced to a different extent by the web tension and by the action of force in the nip than in the case of the "application locations" discussed above.

Furthermore, according to another embodiment of the invention, the writing device is distanced from the winding device, for example at the end of the dryer section of a paper making machine. In this case, the influencing factors discussed above are incorporated differently into the shape of the pattern, for example the J-line.

In order to analyze the aforementioned different influencing factors separately from one another, it is expedient if a plurality of writing devices are arranged at the aforementioned different positions. In this manner, each writing device produces its own pattern, for example a J-line, in parallel with the markings from the other writing devices. It is also expedient if the same clock signal is output to the plurality of writing devices for the respective marking of the material web. In order to make it easier to distinguish the various patterns, for example J-lines, produced in parallel, the markings can be, for example, made using different colors.

When, for example, a writing device is arranged upstream of the nip, in this case changes in web tension and, for example, the action of force of the nip on the material web is incorporated in the shape of the pattern, for example the J-line, and, if a writing device is arranged downstream of the nip, the web tension is incorporated in the shape of the pattern, for example the J-line, in a different relationship, then conclusions about changes in web tension around the pressure roll can be determined from the difference in the two patterns produced by the writing devices upstream and downstream of the nip.

In order to assess the markings placed by the writing unit even during the operation, that it to say with the reel rotating, it is expedient if the marking unit has a sensor unit which detects the markings applied by the writing unit and forming a pattern on the reel. The markings can in this case form a pattern in the shape of a J-line. A suitable sensor unit is, for example, an optical sensor for example, a camera or a camera system.

In order to analyze the information obtained by the sensor unit, it is moreover expedient if the sensor unit is connected to an evaluation unit, allowing sensor signals to be output to the evaluation unit by the sensor unit on the basis of the detected markings.

It is also expedient if the evaluation unit for assessing the patterns, for example J-lines, detected by the sensor unit compares these with reference patterns, for example reference J-lines. Accordingly, the preferred embodiment of the invention has an evaluation unit that compares the received sensor signals with reference signals and outputs evaluation signals.

Suitable reference lines can be, for example, those which represent particularly "good" and particularly "poor" J-lines. Thus, direct conclusions about specific winding defects can be determined, for example from specific shapes of the J-lines.

In order to make the information evaluated by the evaluation unit useful for the current production process, that is to say in order, for example, in the event of "degeneration" of the J-line to act in a controlling and regulating manner on the winding operation, and therefore usable to timely correct winding defects that have already been indicated, it is expedient if the evaluation unit is connected to a control unit, whereby parameters of the winding device and/or one or more sections of the web processing machine connected upstream of the winding device can be controlled, it being possible for evaluation signals to be output to the control unit by the evaluation unit.

Suitable parameters are, for example, winding hardness of the reel and/or web tension and/or the action of force (line force) of the nip comprising reel and pressure roll.

If a plurality of independent markings have been placed by various writing devices, then the resulting patterns, for example J-lines, are evaluated simultaneously by the evaluation unit and evaluation signals are output to the control unit.

On the basis of these output evaluation signals, for example on the basis of the shape of the J-lines, or in order to achieve a desired shape of the J-lines, the control unit in turn outputs control signals to one or more sections of the web-processing machine and to the winding device, by which means parameters important for the winding operation can be controlled.

These and other features and advantages of this invention are described in or are apparent from the following detailed description of the preferred embodiments.

BRIEF DESCRIPTION OF THE DRAWINGS

In the following text, the invention will be explained further by using the following drawing, in which.

Throughout the drawing figures, like reference numerals will be understood to refer to like parts and components.

DETAILED DESCRIPTION OF THE PREFERRED EMBODIMENT

Figure 1:
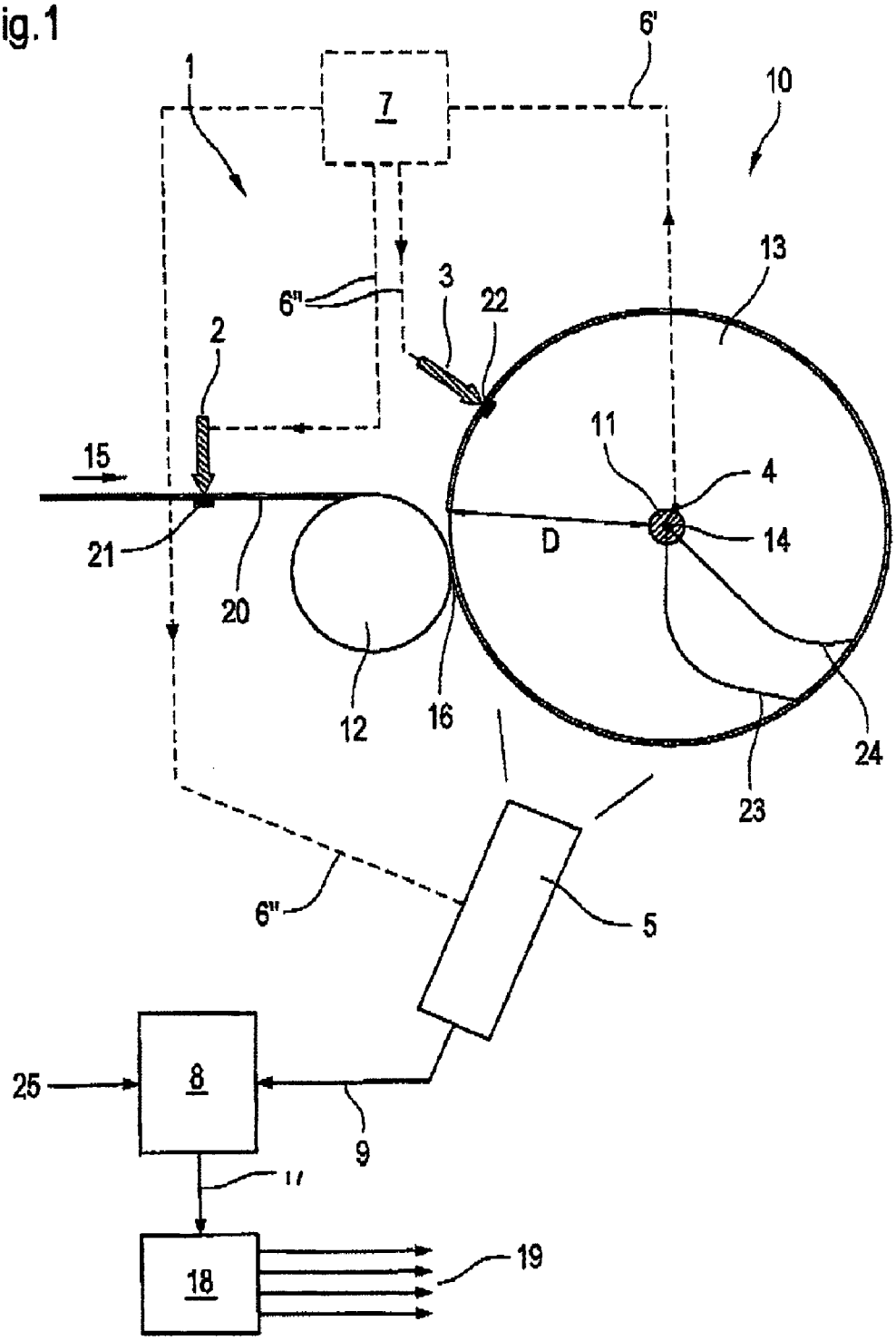
FIG. 1 depicts a marking unit according to the invention.

FIG. 1 shows a marking unit 1 in conjunction with a winding device 10.

The marking unit 1 has a first writing device 2, a second writing device 3, a signal generator 4 and a sensor unit in the form of a camera 5.

The winding device 10 has a core in the form of a spool 11 and a pressure roll 12. As shown in FIG. 1, a material web in the form of a fibrous web 20 has already been wound up on the spool 11 to a certain thickness D, spool 11 and wound part of the fibrous web 20 together forming a reel 13. The reel 13 and the pressure roll 12 are pressed against each other, forming a nip 16 that generates a line force.

The writing device 2 is arranged upstream of the nip 16 in relation to the direction of movement 15 of the fibrous web 20. The writing device 3 is arranged downstream of the nip 16 in relation to the direction of movement 15 of the fibrous web 20.

The signal generator 4 is arranged at the center of rotation 14 of the spool 11 and, in this embodiment, outputs a clock signal 6' upon each full rotation of the spool 11 to a control unit 7, which in turn simultaneously outputs a clock signal 6" to both writing devices 2, 3 and the camera 5. In this embodiment, the clock signal 6' generated by the signal generator 4 is first led to a control unit 7 and the latter distributes a clock signal 6" to the two writing devices 2, 3 and the camera 5. However, it is also conceivable for the signal generator 4 to output clock signals 6" directly to the writing devices 2, 3 and the camera 5.

In each case upon completion of a complete revolution of the spool 11, the two writing devices 2, 3 apply a side marking 21, 22 to the end of the fibrous web 20, so that the markings 21 and 22 on the end face of the reel 13 result in patterns in the form of the two J-lines 23 and 24. The markings 21 and therefore the J-line 23 are in this case produced by the writing device 2. In contrast, the markings 22 and therefore the J-line 24 are produced by the writing device 3.

The J-lines 23 and 24 are detected by the camera 5, which is aimed at the end face of the reel 13. The camera 5 outputs a sensor signal 9 to an evaluation unit 8 connected thereto. The sensor signal 9 is evaluated in the evaluation unit 8, for comparison by, for example, a reference signal 25 representing "good" and/or "poor" J-lines. On the basis of the evaluation of the aforementioned sensor signals 9 and reference signals 25, the evaluation unit 8 outputs evaluation signals 17 to a control unit 18 connected thereto, which in turns outputs control signals 19 to the winding device 10 and/or to sections of the web-processing machine connected upstream of the winding device, in order to influence the winding parameters.

As a result, on the basis of the automatically applied J-lines 23 and 24, the parameters influencing the winding process are controlled in order to obtain optimum quality of the wound reel 13.

Of course, the marking unit described and the marking method described are not restricted to use in the winding of fibrous webs. Instead, the marking unit according to the invention and the marking method according to the invention can be used when winding all types of web-forming materials, such as films, metal sheets and the like.

While the invention has been specifically described in connection with certain specific embodiments thereof, it is to be understood that this is by way of illustration and not of limitation, and the scope of the appended claims should be construed as broadly as the prior art will permit.

LIST OF DESIGNATIONS

1 Marking unit
2 First writing device
3 Second writing device
4 Signal generator
5 Camera
6 Clock signal
7 Control unit
8 Evaluation unit
9 Sensor signal
10 Winding device
11 Spool
12 Pressure roll
13 Reel
14 Center of rotation
15 Direction of movement
16 Nip
17 Evaluation signals
18 Control unit
19 Control signal
20 Fibrous web
21 Marking
22 Marking
23 Pattern (J-line)
24 Pattern (J-line)
25 Reference signal

What we claim as new and desired to be protected by Letters Patent of the United States is:

1. A marking unit comprising:

a writing device that marks a material web, said material web windable onto a core by means of a winding device to form a reel, wherein the marking unit has a signal generator that is operatively connected to the core of the winding device, said signal generator outputting a clock signal to the writing device that marks the material web, the clock signal being output to the writing device by the signal generator upon each completed revolution of the core.

2. The marking unit of claim 1, wherein the signal generator is arranged at the center of rotation of the core.

3. The marking unit of claim 1, wherein the writing device is arranged with respect to the material web in such a way that the marking is applied to the end of the material web.

4. The marking unit of claim 1, wherein the winding device further comprises a pressure roll that forms a nip with a reel, and wherein the writing device is arranged upstream of the nip in relation to the direction of movement of the material web.

5. The marking unit of claim 1, wherein the writing device is arranged such that the material web wound up onto the reel can be marked.

6. The marking unit of claim 1, wherein the marking unit has a plurality of writing devices, the writing devices arranged at different positions.

7. A marking unit comprising:

a writing device that marks a material web, said material web windable onto a core by means of a winding device to form a reel, wherein the marking unit has a signal generator that is operatively connected to the core of the winding device, said signal generator outputting a clock signal to the writing device that marks the material web, wherein the marking unit has a plurality of writing devices, the writing devices arranged at different positions, wherein the clock signal for the respective markings of the material web is output simultaneously to the plurality of writing devices.

8. The marking unit of claim 1, wherein the marking unit further comprises a sensor unit that detects markings applied by the writing device and forming a pattern on the reel.

9. The marking unit of claim 1, wherein the marking unit further comprises a control unit, the sensor unit and at least one writing device controlled by the control unit on the basis of the clock signal output by the signal generator.

10. The marking unit of claim 8, wherein the sensor unit is connected to an evaluation unit, and wherein sensor signals are output to the evaluation unit by the sensor unit on the basis of the pattern detected.

11. The marking unit of claim 10, further comprising a control unit, said control unit receiving evaluation signals from the evaluation unit, wherein the evaluation unit is connected to the control unit, and wherein parameters of one of the winding device and sections of the web-processing machine connected upstream of the winding device and at least one writing device are controlled.

12. The marking unit of claim 10, wherein the evaluation unit compares the sensor signals received with reference signals and outputs evaluation signals on the basis thereof.

13. A method for marking a material web which is wound up onto a core by means of a winding device to form a reel, comprising the steps of:

outputting a clock signal to a writing device utilizing a signal generator operatively connected to the core of the winding device, said clock signal based on rotation of the core, the clock signal being output to the writing device by the signal generator upon each completed revolution of the core; and placing a mark on the material web utilizing the writing device on the basis of the received clock signal.

14. The marking unit of claim 1, wherein the marking unit is configured for controlling a J-line associated with the reel.

* * * * *